United States Patent [19]

Boston et al.

[11] Patent Number: 5,023,113

[45] Date of Patent: Jun. 11, 1991

[54] HOT DIP ALUMINUM COATED CHROMIUM ALLOY STEEL

[75] Inventors: Steven L. Boston, Middletown; Farrell M. Kilbane, Centerville; Danny E. Lee, Middletown; William R. Seay, Franklin; Richard A. Coleman, West Chester, all of Ohio

[73] Assignee: Armco Steel Company, L.P., Middletown, Ohio

[21] Appl. No.: 237,915

[22] Filed: Aug. 29, 1988

[51] Int. Cl.[5] ..... C23C 2/12

[52] U.S. Cl. ..... 427/320; 427/431; 427/432; 148/12 EA

[58] Field of Search ..... 148/12 EF, 12 D; 427/320, 431, 432

[56] References Cited

U.S. PATENT DOCUMENTS 3,320,085 5/1967 Turner, Jr. ..... 117/51
3,925,579 12/1975 Flinchum et al. ..... 427/320
4,155,235 5/1979 Pierson et al. ..... 72/47
4,675,214 6/1987 Kilbane et al. ..... 427/320

FOREIGN PATENT DOCUMENTS 147865 3/1986 Japan .

*Primary Examiner*—Sam Silverberg
*Attorney, Agent, or Firm*—R. J. Bunyard; L. A. Fillow; R. H. Johnson

[57] ABSTRACT

Continuous hot dip aluminum coated ferritic chromium alloy steel strip. Strip is cleaned by heating to a temperature no greater than about 650° C. in a direct fired furnace. The cleaned strip is further heated in a protective atmosphere containing at least 95% by volume hydrogen, cooled in the protective hydrogen atmosphere to near or slightly above the melting point of an aluminum coating metal, and passed into a bath of the aluminum coating metal. The low direct fired furnace cleaning temperature and hydrogen protective atmosphere provides good wetting of a chromium alloy steel surface to prevent uncoated areas or pin holes in the aluminum coated layer.

8 Claims, 1 Drawing Sheet

HOT DIP ALUMINUM COATED CHROMIUM ALLOY STEEL

BACKGROUND OF THE INVENTION

This invention relates to a continuously hot dipped metallic coated ferritic chromium alloy ferrous base strip and a process to enhance the wetting of the strip surface with molten aluminum.

Hot dip aluminum coated steel exhibits a high corrosion resistance to salt and finds various applications in automotive exhaust systems and combustion equipment. In recent years, exhaust system requirements have increased with respect to durability and aesthetics. For this reason, there has become a need to increase high temperature oxidation resistance and salt corrosion resistance by replacing aluminum coated low carbon or low alloy steels with aluminum coated chromium alloy steels. For high temperature oxidation, at least part of the aluminum coating layer can be diffused into the iron base by the heat during use to form an Fe-Al alloy layer. If uncoated areas are present in the aluminum coating layer, accelerated oxidation leading to a perforation of the base metal may result if the Fe-Al alloy is not continuously formed on the base metal. For lower temperatures, the aluminum coating layer acts as a barrier protection for atmospheric conditions and as a cathodic coating in high salt environments. Again, if uncoated areas are present, accelerated corrosion may occur leading to failure of the coated structure.

It is well known to hot dip metallic coat low carbon steel strip without a flux by subjecting the strip to a preliminary treatment which provides a clean surface free of oil, dirt and iron oxide which is readily wettable by the coating metal. One type of preliminary in-line anneal treatment for low carbon steel is described in U.S. Pat. No. 3,320,085 issued to C. A. Turner, Jr. The Turner process, also known as the Selas process, for preparation of low carbon steel strip for hot dip metallic coating includes passing the strip through a direct fired furnace having an atmosphere heated to a temperature of at least 2400° F. (1316° C.). The atmosphere is formed from the gaseous products of combustion of fuel and air and has no free oxygen. The fuel-air ratio is controlled to provide the necessary reducing characteristics for effecting cleaning of the steel strip. The fuel-air ratio is regulated to provide a slight excess of fuel so that there is no free oxygen but excess combustibles in the form of carbon monoxide and hydrogen. Maintaining a furnace atmosphere of at least 1316° C. having at least 3% excess combustibles is reducing to steel up to 1700° F. (927° C.). Turner teaches his cleaned strip is then passed through a sealed delivery duct having a neutral or protective atmosphere prior to passing the cleaned strip into a coating pot. For coating with molten zinc, Turner teaches heating the strip up to 1000° F. (538° C.). For coating with molten aluminum, Turner teaches heating the strip within the temperature range of 1250°-1300° F. (677°-704° C.) in the direct fired furnace since the atmosphere is still reducing to the steel at these temperatures.

Modern direct fired furnaces include an additional furnace section normally heated with radiant tubes. This furnace section contains the same neutral or reducing protective atmosphere, e.g. 75% nitrogen -25% hydrogen, as the delivery duct described above.

U.S. Pat. No. 3,925,579 issued to C. Flinchum et al describes an in-line pretreatment for hot dip aluminum coating low alloy steel strip to enhance wettability by the coating metal. The steel contains one or more of up to 5% chromium, up to 3% aluminum, up to 2% silicon and up to 1% titanium, all percentages by weight. The strip is heated to a temperature above 1100° F. (593° C.) in an atmosphere oxidizing to iron to form a surface oxide layer, further treated under conditions which reduce the iron oxide whereby the surface layer is reduced to a pure iron matrix containing a uniform dispersion of oxides of the alloying elements.

The problems associated with nonwetting of aluminum coatings onto ferritic chromium alloy steel are also well known. Hot dip aluminum coatings have poor wettability to ferritic chromium alloy steel base metals and normally have uncoated or bare spots in the aluminum coating layer. By poor adherence is meant flaking or crazing of the coating during bending the strip. To overcome the adherence problem, some have proposed heat treating the aluminum coated steel to anchor the coating layer to the base metal. Others lightly reroll the coated chromium alloy steel to bond the aluminum coating. Finally, those concerned about uncoated spots have generally avoided continuous hot dip coating. Rather, batch type hot dip coating or spray coating processes have been used. For example, after a chromium alloy steel article has been fabricated, it is dipped for an extended period of time within an aluminum coating bath to form a very thick coating layer.

U.S. Pat. No. 4,675,214 issued to F. M. Kilbane et al, incorporated herein by reference, proposes a solution for enhancing the wetting of ferritic chromium alloy steel strip continuously coated with hot dip aluminum coatings. The Kilbane process includes cleaning a ferritic chromium alloy steel and passing the cleaned steel through a protective hydrogen atmosphere substantially void of nitrogen prior to entry of the steel into an aluminum coating bath. This process resulted in improved wetting of ferritic chromium alloy steel so long as the steel was not cleaned by heating to an elevated temperature in a direct fired furnace. According to Turner, a direct fired furnace having an atmosphere with at least 3% combustibles heated to 2400° F. (1316° C.) is reducing to steel up to 1700° F. (927° C.). Nevertheless, heating ferritic chromium alloy steel at temperatures about 1250° F. (677° C.) and above in a direct fired furnace whose atmosphere has no free oxygen and subsequently passing the steel through a protective atmosphere of substantially pure hydrogen immediately prior to hot dip coating with aluminum still had large uncoated areas. Not being bound by theory, it is believed a direct fired furnace atmosphere having no free oxygen does have significant oxidizing potential due to the presence of water and apparently is oxidizing to the chromium contained in a chromium alloy ferrous strip. The chromium oxide formed on the surface of the strip apparently is not removed sufficiently by the protective hydrogen atmosphere prior to entry into the coating bath thereby preventing complete wetting of the strip surface.

BRIEF SUMMARY OF THE INVENTION

The invention relates to a continuous hot dip aluminum coated ferritic chromium alloy steel strip heated in a direct fired furnace by the combustion of fuel and air wherein the gaseous products of combustion have no free oxygen. The surface of the strip is heated to a temperature sufficient to remove oil, dirt, iron oxide, and the like but below a temperature causing excessive oxidation of chromium in the strip base metal. The strip is further heated in another furnace portion and is cooled, if necessary, to near or slightly above the melting point of an aluminum coating metal. The strip is then passed through a protective atmosphere of at least 95% by volume hydrogen and then into a molten bath of the aluminum coating metal to deposit a layer of the coating metal on the strip.

It is a principal object of this invention to form hot dip aluminum coated ferritic chromium alloy steels having enhanced wetting by the coating metal.

It is another object of the invention to form a hot dip aluminum coating on a chromium alloy steel strip cleaned in a direct fired furnace.

It is a further object of the invention to form a hot dip aluminum coating on a deep drawing chromium alloy steel strip that is annealed in-line on the coating line.

One feature of the invention is to clean a ferritic chromium alloy steel strip having enhanced wetting by an aluminum coating by heating the strip in a direct fired furnace on an aluminum coating line below a temperature creating excessive oxidation of chromium contained in the strip.

Another feature of the invention is to further heat the cleaned chromium alloy steel strip to a fully annealed condition in another furnace portion having a protective atmosphere containing at least about 95% by volume hydrogen.

Another feature of the invention is to supply less than 80% of the total thermal energy required to fully anneal the deep drawing ferritic chromium alloy steel strip in the direct fired furnace of the aluminum coating line.

Another feature of the invention is to maintain the cleaned chromium alloy steel strip in a protective atmosphere containing at least about 95% by volume hydrogen, less than 200 ppm oxygen, and having a dew point less than +40° F. (+4° C.) until the cleaned strip is passed into the aluminum coating metal.

Another feature of the invention is to fully anneal and cool the heated chromium alloy steel strip in a protective atmosphere containing at least 95% by volume hydrogen having a dew point no greater than 0° F. (−18° C.), pass the strip through a snout containing a protective atmosphere containing at least 97% by volume hydrogen having a dew point no greater than −20° F. (−29° C.), and then dip the strip into the aluminum coating metal.

Advantages of the invention are elimination of uncoated areas and improved adherence to ferritic chromium alloy steel strip cleaned in a direct fired furnace and continuously hot dip coated with aluminum.

DETAILED DESCRIPTION OF THE PREFERRED EMBODIMENT

Figure 1:
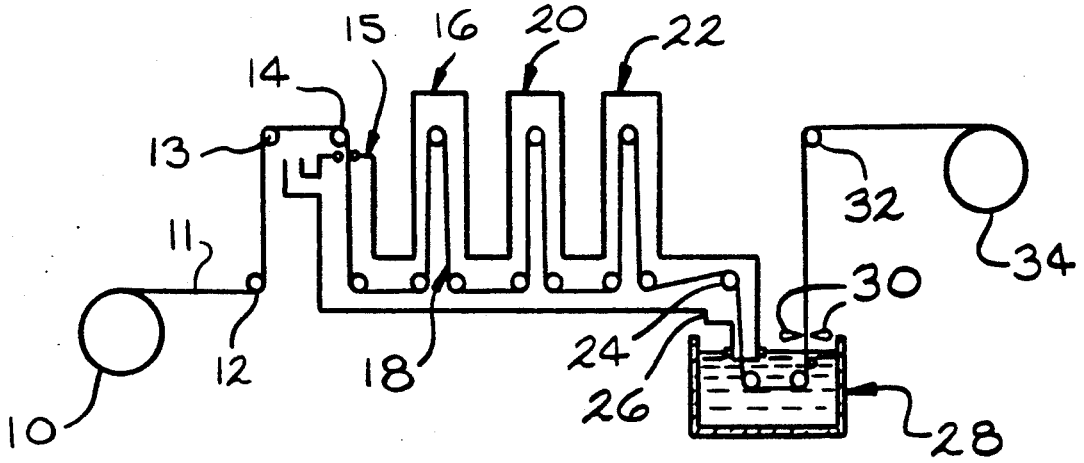
FIG. 1 is a schematic view of a ferrous base strip being processed through a hot dip aluminum coating line incorporating the present invention.

Referring now to FIG. 1, reference numeral 10 denotes a coil of steel with strip 11 passing therefrom and around rollers 12, 13 and 14 before entering the top of first furnace section 15. First furnace section 15 is a direct fired type heated by the combustion of fuel and air. The ratio of fuel and air is in a proportion so that the gaseous products of combustion have no free oxygen and preferably at least 3% by volume excess combustibles. The atmosphere in furnace 15 is heated preferably to greater than 2400° F. (1316° C.) and strip 11 maintained at sufficient speed so that the strip surface temperature is not excessively oxidizing to chromium while removing surface contaminants such as rolling mill oil films, dirt, iron oxide, and the like. Except for a brief period of time as explained in detail later, the strip should not be heated to a temperature above about 1200° F. (649° C.) and preferably not above about 1150° F. (621° C.) while in furnace 15.

The second section of the furnace denoted by numeral 16 may be of a radiant tube type. The temperature of strip 11 is further heated to at least about the melting point of an aluminum coating metal, i.e. 1200° F. (649° C.), and up to about 1750° F. (955° C.) reaching a maximum temperature at about point 18. A protective atmosphere including at least about 95% by volume hydrogen preferably is maintained in furnace section 16 as well as succeeding sections of the furnace described below.

Sections 20 and 22 of the furnace are cooling zones. Strip 11 passes from furnace portion 22, over turndown roller 24, through snout 26 and into coating pot 28 containing molten aluminum. The strip remains in the coating pot a very short time, i.e. 2–5 seconds. Strip 11 containing a layer of coating metal on both sides is vertically withdrawn from coating pot 28. The coating layers are solidified and the coated strip is passed around turning roller 32 and coiled for storage or further processing as a coil 34. As noted above, furnace sections 20, 22 and 26 contain the protective hydrogen atmosphere.

Figure 2:
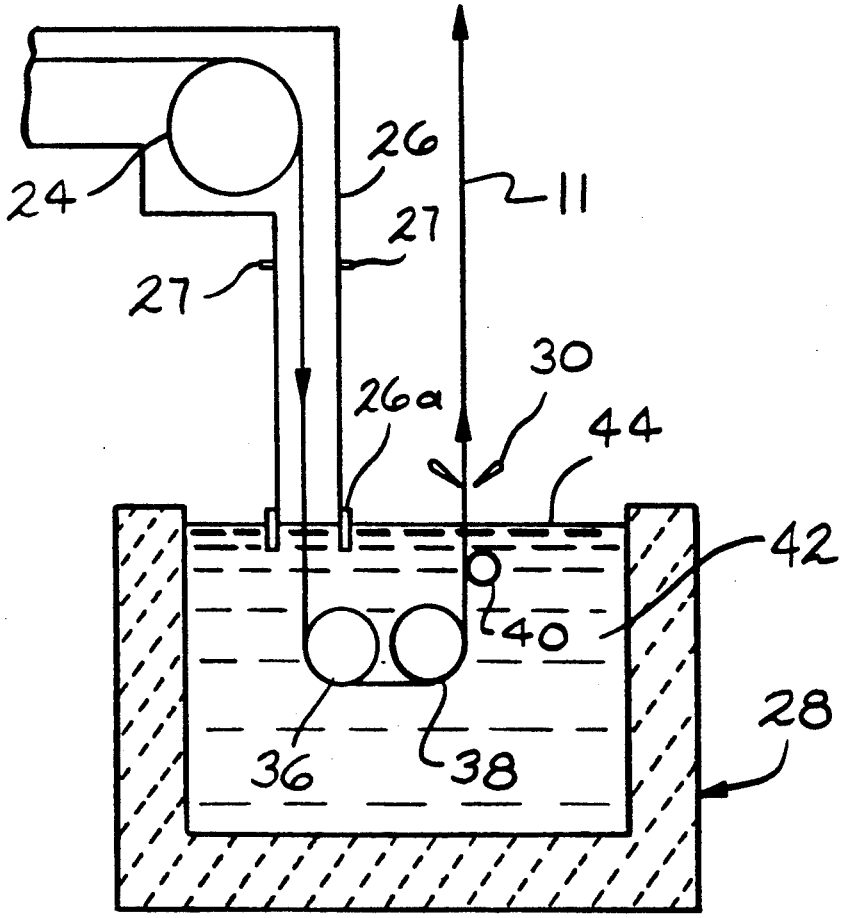
FIG. 2 is a partial schematic view of the coating line of FIG. 1 showing an entry snout and coating pot.

Referring now to FIG. 2, snout 26 is protected from the atmosphere by having its lower or exit end **26*a* submerged below surface 44 of aluminum coating metal 42. Suitably mounted for rotation are pot rollers 36 and 38 and stabilizer roller 40. The weight of coating metal 42 remaining on strip 11 as it is withdrawn from coating pot 28 is controlled by finishing means such as jet knives 30. Strip 11 is cooled to a temperature near or slightly above the melting point of the aluminum coating metal in furnace portions 20, 22 and 26 before entering coating pot 28**. This temperature may be as low as 1150° F. (620° C.) for aluminum alloy coating metals, e.g. Type 1 containing about 10% by weight silicon, to as high as about 1350° F. (732° C.) for commercially pure aluminum coating metal, e.g. Type 2.

The apparatus shown in FIG. 2 is for two-side coating using air finishing. As will be understood by those skilled in the art, finishing using a sealed enclosure containing a nonoxidizing atmosphere may also be used.

Hydrogen gas of commercial purity may be introduced into the furnace sections through inlets 27 in snout 26 preferably to achieve a protective hydrogen atmosphere containing less than about 200 ppm oxygen and having a dew point no greater than +40° F. (+4° C.). Depending upon factors such as hydrogen flow rate and furnace volume, additional hydrogen inlets may be required in furnace sections 16, 20 and 22.

Ferritic chromium alloy steels as defined herein include iron based magnetic materials characterized by a body centered cubic structure and having about 0.5 weight % or more chromium. For example, the present invention has particular usefulness for hot dip aluminum coated ferritic stainless steel having up to about 35% by weight chromium and is used in automotive exhaust applications including heavy gauge engine exhaust pipes having thicknesses of 1.2 mm or more, foil having thicknesses less than 0.25 mm cold reduced from aluminized strip used as catalyst supports for catalytic converters, and fully annealed strip deeply drawn into parts requiring light weight aluminum coatings, e.g. no greater than 185 gm/m$^2$ total both sides, such as manifolds, muffler parts, catalytic converters, resonators, and the like. By full annealing is meant the strip is heated to at least about 830° C. in furnace 16 and will have at least about 25% elongation as measured in a tensile test. Type 409 ferritic stainless steel is particularly preferred as the starting material for the present invention. This steel has a nominal composition of about 11% by weight chromium, about 0.5% by weight silicon, and remainder essentially iron. More broadly, a ferritic steel containing from about 10.0% to about 14.5% by weight chromium, about 0.1% to 1.0% by weight silicon, and remainder essentially iron, is preferred.

The following are nonlimiting examples illustrating the invention:

EXAMPLE 1

A 1.02 mm thick by 122 cm wide Type 409 stainless steel strip was coated with pure molten aluminum coating (Type 2) at a temperature of 699°-704° C. using the coating line in FIGS. 1 and 2. Hydrogen of commercial purity was flowed at a rate of about 380 m$^3$/hr into snout 26 and an atmosphere of 75% by volume nitrogen and 25% by volume hydrogen was maintained in furnace portion 16. The dew point of the pure protective hydrogen atmosphere in snout 26 was initially +48° F. (+9° C.). The fuel to air ratio in direct fired furnace portion 15 was controlled to have about 5% by volume excess combustibles. For various strip speeds and temperatures, the following visual observations were made:

| Sample | Speed (m/min) | DFF (°C.)* | RT (°C.)** | Oxide*** | Coating Condition |
|---|---|---|---|---|---|
| A | 37 | 760 | 917 | Dark Blue | random un-coated areas |
| B | 46 | 704 | 917 | Light Blue | random un-coated areas |
| C | 55 | 649 | 871 | Gold | uncoated strip edge only |
| D | 37 | 649 | 871 | Gold | good coating |

*Strip temperature in furnace portion 15.
**Strip temperature in furnace portion 16
***Surface appearance as strip 11 passed from furnace 15

As demonstrated above, a ferritic chromium alloy steel is oxidized when heated to a temperature of at least 649° C. in an atmosphere of combustion products having no free oxygen. The dew point of the hydrogen atmosphere in snout 26 increased to a maximum of about +58° F. (+14° C.) as a result of at least some of the iron and/or chromium oxide being reduced to metal and water by the hydrogen atmosphere. Samples A and B heated to at least 704° C. in the direct fired furnace were excessively oxidized and not properly wetted by the aluminum coating metal. The amount of oxidation to the strip when heated to 649° C. in the direct fired furnace was marginally excessive as demonstrated by poor coating wetting along one edge of Sample C. Using a very dry protective hydrogen atmosphere, e.g. dew point no greater than 0° F. (−19° C.), throughout furnace portions 16, 20, 22 and snout 26 probably would have sufficiently removed the oxide on Sample C to result in better wetting of the aluminum coating metal. Contrary to conventional wisdom for low carbon steel, ferritic chromium steel is readily oxidized in an atmosphere having no free oxygen and excess combustibles when heated to at least 649° C.

EXAMPLE 2

A 1.64 mm thick by 94 cm wide coil of Type 409 stainless steel was coated with 183 gm/m$^2$ of Type 2 aluminum (total both sides) under similar conditions to that of Example 1 except the pure protective hydrogen atmosphere also was maintained in furnace portion 16 and cooling zones 20, 22. Prior to passing this coil through the coating line, the dew point of the hydrogen atmosphere in snout 26 was −9° F. (−23° C.). The following coating observations were made for various strip temperatures:

| Sample | DFF (°C.) | RT (°C.) | Coating Appearance |
|---|---|---|---|
| A | 817 | 908 | poor, frequent uncoated spots |
| B | 620 | 841 | good, infrequent uncoated spots |

EXAMPLE 3

Three coils of Type 409 stainless steel were processed and coated with 137 gm/m$^2$ Type 2 aluminum (total both sides) under similar conditions as in Example 2 except the dew point of the hydrogen atmosphere in snout 26 was −50° F. (−46° C.) and the dew point in radiant tube furnace portion 16 was −4° F. (−20° C.). The following coating observations were made for various strip temperatures:

| Sample | Thickness (mm) | Width (cm) | DFF (°C.) | RF (°C.) | Coating Appearance |
|---|---|---|---|---|---|
| A | 1.4 | 117 | 676 | 892 | Some uncoated spots |
| B | 1.3 | 91 | 677 | 902 | Scattered uncoated spots esp. 10 cm from one edge |
| C | 1.4 | 76 | 604 | 871 | No uncoated spots |

As clearly demonstrated in Examples 1-3, heating the strip to temperatures of at least 676° C. in the direct fired furnace caused excessive oxidation of the strip. Using a very dry protective hydrogen atmosphere throughout the furnace portions 16, 20, 22 and snout 26 did not sufficiently remove the oxides to achieve good coating metal wetting. On the other hand, heating the strip to no greater than about 650° C. in the direct fired furnace and further heating the strip to temperatures greater than about 830° C. in the radiant tube furnace resulted in adherent aluminum coatings having minimal uncoated areas on a fully annealed strip capable of being deeply drawn without flaking or crazing the coating.

EXAMPLE 4

A 1.08 mm thick by 76 cm wide Type 409 stainless steel coil was also successfully continuously hot dip coated with 119 gm/m$^2$ (total both sides) of an aluminum alloy (Type 1) containing 9% by weight silicon. Operating conditions were the same as in Example 2. The strip was heated to about 627° C. in furnace portion 15 and to 829° C. in furnace portion 16. Very few uncoated areas were observed.

EXAMPLES 5-10

Examples 5 through 10 are for 0.38 mm thick by 12.7 cm wide strip for ferritic, low carbon, titanium stabilized steels containing 2.01, 4.22 and 5.99% by weight chromium. These samples were continuously hot dip aluminum coated (Type 2) on a laboratory coating line similar to that shown in FIGS. 1 and 2 and under conditions similar to those for Example 2. Weights of coating were not measured.

| No. | % Cr | Speed (m/min) | DFF* (°C.) | % $H_2$** | Condition |
|---|---|---|---|---|---|
| 5 | 2.01 | 7.6 | 1204 | 25 | Poor Coating |
| 6 | 4.22 | 12.2 | 1093 | 25 | Poor Coating |
| 7 | 5.99 | 12.2 | 1193 | 25 | Poor Coating |
| 8 | 2.01 | 9.1 | 1227 | 100 | Very good coating |
| 9 | 4.22 | 9.1 | 1238 | 100 | Good coating |
| 10 | 5.99 | 9.1 | — | 100 | Good coating |

*Furnace Zone temperatures
**Hydrogen content in protective atmosphere

While strip temperatures out of the direct fired furnace were not measured, the data clearly supports the use of a 100% by volume hydrogen atmosphere in all areas of the furnace except the direct fired portion. Since the chromium content was lowered in Examples 5-10 from previous examples (11% by weight), it is reasonable to expect less dependence on direct fired furnace strip exit temperature with the lower chromium alloys (2, 4, 6% by weight). In other words, there would be less oxidation potential with less chromium content.

As noted above, a direct fired atmosphere of the gaseous products of combustion of fuel and air having no free oxygen is oxidizing to ferritic chromium alloy steel at about 1200° F. (649° C.). Accordingly, the strip temperature in direct fired furnace 15 should not exceed this temperature, particularly for ferritic stainless steel having chromium content of 10% by weight or more. Preferably, this strip cleaning temperature should not exceed about 1150° F. (621° C.). Nevertheless, the strip temperature on occasion will exceed 649° C. resulting from strip width and/or gauge changes. Brief excursions, i.e. less than 10 minutes of temperature about or slightly above 649° C., can be tolerated by carefully controlling the protective atmosphere conditions throughout furnace portion 16, cooling zones 20, 22 and snout 26. By maintaining a protective atmosphere containing at least about 95% by volume hydrogen in furnace portion 16, cooling zones 20, 22 and snout 26, minimal oxidization of strip 11 in furnace portion 15 can be removed. In this regard, we have determined it to be especially beneficial to maintain extremely low dew points in the protective hydrogen atmosphere to compensate for water formation as iron and/or chromium oxide is reduced by hydrogen in the protective atmosphere. Preferably, the protective atmosphere in snout 26 contains at least 97% by volume hydrogen and the dew point should not exceed about −20° F. (−29° C.). A dew point of 0° F. (−18° C.) preferably should be maintained in furnace portion 16 and cooling zones 20, 22.

As disclosed in U.S. Pat. No. 4,675,214, the reactivity of the aluminum coating metal increases at elevated temperatures. Accordingly, maintaining the aluminum coating at 1280°-1320° F. (693°-716° C.) also helps to remove any residual surface oxide not removed by the protective atmosphere. However, removal of oxide from the strip surface while submerged in the aluminum coating metal bath is undesirable because the reduced oxide forms aluminum oxide (dross) on the surface of the coating bath. Aluminum oxide can also cause uncoated areas by attachment as fragments to the strip as it emerges from the coating pot preventing metallurgical bonding of the aluminum coating metal to the steel strip.

The teachings of the present invention are especially important when high strip temperatures, e.g. greater than 830° C., are required for full annealing to produce deep drawing strip for high formability products. For high temperature annealing for low carbon steel strip, up to about 90% of the total heat input to the strip is accomplished in the direct fired portion of the furnace. The tables below show the percent of total thermal content achieved in the direct fired furnace portion for low carbon steel (prior art) and for ferritic chromium alloy steel (invention).

| t (mm) | w (cm) | t × w | s (mpm) | $T_1$ (°C.) | $T_2$ (°C.) | MW/Hr. To $T_1$ | MW/Hr. To $T_2$ | % $T_2$* |
|---|---|---|---|---|---|---|---|---|
| | | | | Prior Art | | | | |
| .81 | 76 | 62 | 95 | 760 | 857 | 3.9 | 4.4 | 88.4 |
| 1.40 | 76 | 106 | 64 | 749 | 857 | 4.4 | 5.0 | 87.0 |
| 1.75 | 86 | 151 | 43 | 760 | 857 | 4.3 | 4.9 | 88.4 |
| | | | | Invention | | | | |
| .81 | 76 | 62 | 64 | 624 | 831 | 2.1 | 2.9 | 74.5 |
| 1.40 | 76 | 106 | 40 | 628 | 832 | 2.3 | 3.1 | 74.8 |
| 1.75 | 86 | 151 | 33 | 631 | 849 | 2.8 | 3.8 | 73.6 |

t = strip thickness
w = strip width
s = strip speed through furnace
$T_1$ = strip temperature in direct fired furnace
$T_2$ = strip temperature in radiant tube heated furnace
* = % total thermal content As demonstrated above, nearly 90% of total thermal content for fully annealed low carbon steel is achieved in the direct fired portion of the furnace while less than 80% of total thermal content for fully annealed hot dip aluminum coated chromium alloy steel can be achieved in the direct fired portion of the furnace if excessive oxidation is to be avoided. In other words, for fully annealed strip of the invention, the maximum allowed direct fired furnace strip temperature must be less than that necessary to provide at least 80% of total thermal input.

Various modifications can be made to the invention without departing from the spirit and scope of it so long as the chromium alloy steel strip is not heated to a temperature excessively oxidizing to the strip in a direct fired furnace and is passed through a protective atmosphere containing at least about 95% by volume hydrogen prior to entry into the coating metal bath. For example, the hydrogen atmosphere can be used throughout any heating and cooling portions of the coating line between the direct fired furnace and the coating pot delivery duct. The coating metal can include pure aluminum and aluminum base alloys. The coating metal weight may be controlled by finishing in air or a sealed enclosure. Therefore, the limits of the invention should be determined from the appended claims.

What is claimed is:

1. A method of continuous hot dip coating a steel strip with aluminum, comprising the steps of:

heating a ferritic chromium alloy steel strip to a temperature no greater than about 650° C. by direct combustion of fuel and air wherein the gaseous products of said combustion have no free oxygen, further heating said strip to a temperature of at least about 830° C., cooling said strip to a temperature near or slightly above the melting point of an aluminum coating metal, passing said strip through a protective atmosphere having at least about 95% by volume hydrogen, dipping said strip into a molten bath of said coating metal to deposit a coating layer on said strip, said coating layer being substantially free of uncoated areas and tightly adherent to said strip.

2. The method of claim 1 wherein said strip is heated to no greater than about 621° C. by said direct combustion of fuel and air.

3. The method of claim 1 wherein said strip is further heated to a temperature of 845° C. to 955° C. in said atmosphere.

4. The method of claim 1 wherein said strip is cooled in said atmosphere.

5. The method of claim 1 wherein said atmosphere has less than about 200 ppm oxygen and a dew point of less than about +4° C.

6. The method of claim 1 wherein said coating metal is substantially pure aluminum.

7. The method of claim 1 wherein said strip includes at least 10% by weight chromium.

8. A method of continuous hot dip coating a steel strip with aluminum, comprising the steps of:

heating a ferritic chromium alloy steel strip in a first furnace portion of the direct fired type to a temperature no greater than about 650° C., further heating said strip to a temperature at least about 830° C. in a second furnace portion containing a protective atmosphere of at least about 95% by volume hydrogen having a dew point no greater than −18° C., cooling said strip in said atmosphere to near or slightly above the melting point of an aluminum coating metal, passing said strip through an enclosed snout containing said atmosphere and into a molten bath of said coating metal to deposit a coating layer on said strip, said atmosphere in said snout having at least about 97% by volume hydrogen having a dew point no greater than −29° C., said coating layer being substantially free of uncoated areas and tightly adherent to said strip.

* * * * *